US007675242B2

(12) United States Patent
Longhino et al.

(10) Patent No.: US 7,675,242 B2
(45) Date of Patent: Mar. 9, 2010

(54) ELECTRONIC BALLAST

(75) Inventors: Werner Longhino, Mehring (DE); Thomas Mudra, Kastl (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 224 days.

(21) Appl. No.: 11/793,142

(22) PCT Filed: Dec. 20, 2005

(86) PCT No.: PCT/DE2005/002295

§ 371 (c)(1),
(2), (4) Date: Jun. 14, 2007

(87) PCT Pub. No.: WO2006/074629

PCT Pub. Date: Jul. 20, 2006

(65) Prior Publication Data

US 2008/0106215 A1 May 8, 2008

(30) Foreign Application Priority Data

Jan. 11, 2005 (DE) ..... 10 2005 001 326

(51) Int. Cl.
*H05B 39/00* (2006.01)
*H05B 41/21* (2006.01)

(52) U.S. Cl. ..... 315/276; 315/281

(58) Field of Classification Search ..... 315/312, 315/276, 277, 278, 279, 280, 283, DIG. 5
See application file for complete search history.

(56) References Cited

U.S. PATENT DOCUMENTS

| | | | | |
|---|---|---|---|---|
| 5,504,399 | A * | 4/1996 | Tobler | 315/278 |
| 6,028,400 | A | 2/2000 | Pol et al. | |
| 6,118,223 | A | 9/2000 | Canova | |
| 6,717,371 | B2 * | 4/2004 | Klier et al. | 315/274 |
| 6,717,372 | B2 * | 4/2004 | Lin et al. | 315/282 |
| 6,781,325 | B2 * | 8/2004 | Lee | 315/282 |
| 7,187,139 | B2 * | 3/2007 | Jin | 315/274 |
| 2002/0047602 | A1 | 4/2002 | Franck et al. | |
| 2003/0015974 | A1 | 1/2003 | Klier et al. | |

FOREIGN PATENT DOCUMENTS

| | | |
|---|---|---|
| DE | 101 34 966 | 6/2003 |
| EP | 0 326 114 | 1/1989 |
| EP | 0 766 500 | 4/1997 |
| EP | 0 855 850 | 7/1998 |

* cited by examiner

*Primary Examiner*—Douglas W Owens
*Assistant Examiner*—Minh D A

(57) ABSTRACT

An electronic ballast for the operation of a lamp arrangement includes at least one lamp, in particular, a low-pressure discharge lamp and at least one transformer for balancing the lamp currents, whereby the transformer has two windings, provided for one or more lamps of the lamp arrangement. The transformer is embodied as a saturation balancing choke.

13 Claims, 1 Drawing Sheet

ELECTRONIC BALLAST

TECHNICAL FIELD

The invention relates to an electronic ballast (EB) for operating a lamp arrangement in accordance with the precharacterizing clause of patent claim 1.

PRIOR ART

Discharge lamps are often operated with the aid of electronic ballasts which convert the low-frequency system supply voltage into a high-frequency AC voltage. As a result, the efficiency of the lamps is increased and a longer life is achieved.

With such electronic ballasts, in particular in the case of the control of the light quantity (so-called dimming) of the lamp arrangement, the problem may occur that the individual lamps illuminate at different brightnesses. When the lamps are connected in parallel, this problem is usually caused by different currents in the individual current branches of the electronic ballast, but also occurs in the case of lamps which are arranged in the same current branch, i.e. are connected in series. In particular when the ballast is designed to have an inverter and a downstream series resonant circuit, the lamps which are connected directly to the resonant circuit components illuminate more brightly than the lamps connected downstream. On the other hand, this problem is also apparent, however, when operating only one individual lamp, to be precise in the form of lamp ends illuminating at different brightnesses. The mentioned differences in brightness further increase as the luminous flux decreases, i.e. as the dimming of the lamp arrangement increases.

In order to solve the abovementioned problems, an electronic ballast has already been disclosed in DE 101 34 966 A1, in which transformers are used for balancing the lamp currents which, owing to their opposite winding arrangement, act as differential current transformers and, as a result, balance the currents in the individual current branches. Disadvantages with such circuit arrangements are firstly that even during the preheating phase premature ignition and therefore damage to the lamps may occur and, secondly, it is possible to start the lamp even in the case of a lamp which has been inserted at one end into the lampholder and there is a risk of an accident as a result of an electric shock by means of touching the contact pin at the free lamp end (so-called thumb test). For this reason it is necessary to monitor all the lamp ends using a suitable safety circuit, such as, for example, using a DC path, which closes when the lamp end has been inserted and, only when all the lamp ends have been completed inserted, enables the starting operation in order to satisfy the mentioned safety provisions (thumb test). Such safety circuits are associated with increased production complexity, however.

DESCRIPTION OF THE INVENTION

The invention is based on the object of providing an electronic ballast (EB) for operating a lamp arrangement, in which, in comparison with conventional solutions, uniformly bright illumination of all the lamps and protection against premature ignition and electric shock are made possible with as few production costs as possible.

This object is achieved according to the invention by the features of claim 1. Particularly advantageous embodiments of the invention are described in the dependent claims.

The electronic ballast (EB) according to the invention for operating a lamp arrangement having at least one lamp, in particular a low-pressure discharge lamp, has at least one transformer for balancing the lamp currents, the transformer having two windings, which are assigned to one or more lamps of the lamp arrangement. According to the invention, the transformer is in the form of a saturation balancing inductor. On the one hand, this inductor balances the lamp currents, with the result that, in the case of an individual lamp, its ends and, in the case of a series circuit comprising a plurality of lamps, all the lamps illuminate at a uniform brightness, while on the other hand it also limits the voltages occurring owing to a saturation of the ferromagnetic transformer core which is set in a defined manner. The current intensity at which the saturation occurs is set such that decoupling of the turns of the transformer occurs even at a substantially lower voltage than is required for reigniting the lamps. Voltages which result in premature ignition during the preheating phase and therefore in damage to the lamps are prevented. Furthermore, voltages are prevented which result in unintentional reignition and therefore in a risk of an accident owing to an electric shock for the user. As a result, special safety circuits, as are required in conventional solutions, are no longer required.

In accordance with one particularly preferred embodiment, the saturation balancing inductor is set such that the saturation of the ferromagnetic core occurs at a current in the range of 5-50 mA. As a result, on the one hand only low lamp currents are balanced at which the differences in brightness are at their greatest, while, on the other hand, voltages are also prevented which result in reignition of the lamp during the preheating phase and in a risk as a result of electric shock.

Preferably, the electronic ballast has a series resonant circuit, which comprises a coil and a capacitor.

The windings of the transformers preferably have the same number of turns and are arranged with opposite winding systems.

In accordance with a first variant of the electronic ballast, a first winding of the transformer is arranged upstream of the lamp arrangement, and a second winding of the transformer is arranged downstream of the lamp arrangement. This ensures that the currents upstream and downstream of a lamp arrangement comprising one or more lamps are balanced and all the lamps of the lamp arrangement or both ends of an individual lamp illuminate at a uniform brightness.

In a second variant of the invention having two parallel-connected current branches, in each case a first winding of the transformer is arranged upstream of the lamp arrangement, and a second winding of the transformer is arranged downstream of the lamp arrangement.

It has proven to be particularly advantageous if in addition in each case one winding of a further balancing transformer is connected upstream of the first windings of the transformers. As a result of the fact that the two windings of the balancing transformer have the same number of turns and are designed to have opposite winding senses, the balancing transformer likewise functions as a differential current transformer and balances the partial currents in the parallel-connected current branches. This measure ensures that all of the lamps of the lamp arrangement even in parallel-connected current branches illuminate at the same brightness.

In accordance with a third variant according to the invention, the electronic ballast has two parallel-connected current branches, each having at least one lamp arrangement, the first winding of the transformer being arranged downstream of the first lamp arrangement, and the second winding of the transformer being arranged downstream of the second lamp arrangement.

Preferably, in each case one winding of an additional balancing transformer is connected upstream of the lamp arrangement in the parallel-connected current branches. Said balancing transformer functions, as already explained, as a differential current transformer and balances the partial currents in the parallel-connected current branches in order to ensure that all of the lamps of the lamp arrangement illuminate at the same brightness.

In this exemplary embodiment, the series resonant circuit is preferably arranged upstream of the parallel circuit comprising the two current branches.

In a fourth variant of the invention having two parallel-connected current branches and in each case at least one lamp arrangement, the first winding of the transformer is connected downstream of the first lamp arrangement, and the second winding of the transformer is connected downstream of the second lamp arrangement, in each case a separate series resonant circuit in the current branches being connected upstream of the lamp arrangement. Said separate series resonant circuit balances the partial currents in the parallel-connected current branches, which partial currents may differ from one another for example owing to different manufacturing tolerances of the electronic components (coils, capacitors etc.). This ensures that the lamps in the parallel-connected current branches illuminate at the same brightness.

In accordance with one exemplary embodiment, the described lamp arrangement may have one or more lamps.

In accordance with a further embodiment of the invention, the electronic ballast is preferably in the form of an inverter, in particular in the form of a half-bridge inverter.

BRIEF DESCRIPTION OF THE DRAWINGS

The invention will be explained in more detail below with reference to preferred exemplary embodiments, in which.

PREFERRED EMBODIMENTS OF THE INVENTION

FIGS. 1 to 4 merely show the load circuit of the electronic ballast according to the invention and drive electronics 1, to which a high-frequency AC voltage produced by a half-bridge inverter (not illustrated) is applied. The components of the electronic ballast which continue to be arranged upstream of the load circuit, such as the input filter and the rectifier, for example, have long been known from the prior art and are therefore not explained in any more detail below.

The load circuit initially comprises a coil L1 and a capacitor C1, which form a series resonant circuit, the first terminal of the resonant capacitor C1 being connected to the resonant coil L1, and the second terminal of the capacitor C1 being connected to the ground potential. The first terminal of the resonant capacitor C1 is furthermore connected, via a series and/or parallel circuit of a lamp arrangement 2, to the first terminal of a half-bridge capacitor C2, and the second terminal of the half-bridge capacitor C2 is connected to the ground potential. The ballast according to the invention is used for operating a lamp arrangement having at least one low-pressure discharge lamp, which lamps are provided with in each case two preheatable electrode filaments for generating a gas discharge.

In order to make gentle lamp operation possible, a heating current can be applied to the electrode filaments via a heating apparatus H.

Figure 1:
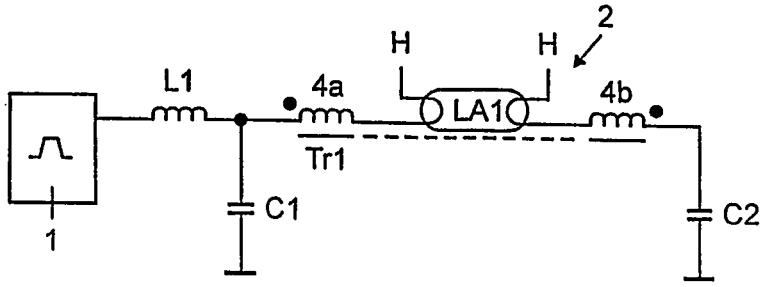
FIG. 1 shows a schematic circuit arrangement of an electronic ballast in accordance with a first exemplary embodiment.

In accordance with a first exemplary embodiment of the invention, the electronic ballast is used for operating an individual lamp LA1. FIG. 1 shows the schematic circuitry for this ballast. The lamp LA1 is connected into the load circuit between the first terminal of the resonant capacitor C1 and the first terminal of the half-bridge capacitor C2. According to the invention, the electronic ballast has a transformer Tr1 in the form of a saturation balancing inductor and having two windings 4*a*, 4*b* with the same number of turns and opposite winding systems. The windings 4*a*, 4*b* are connected in series with the lamp LA1, are magnetically coupled to one another via a ferromagnetic core and have the lamp current flowing through them in opposite directions. The first winding 4*a* of the transformer Tr1 is connected upstream of the lamp LA1, and the second winding 4*b* of the transformer Tr1 is connected downstream of the lamp LA1, into the load circuit of the half-bridge inverter, with the result that the transformer Tr1 functions as a differential current transformer, and the lamp currents are balanced upstream and downstream of the lamp LA1. According to the invention, the transformer Tr1 in the form of a saturation balancing inductor carries out both the balancing of the lamp current which is required for uniformly bright illumination of the ends of the lamp LA1 and the limitation of the voltages occurring by saturation of the ferromagnetic transformer core which is set in a defined manner, at a current in the range of 5-50 mA. As a result, firstly only low lamp currents are balanced at which the differences in brightness are at their greatest, and, secondly, voltages are avoided which result in premature ignition of the lamp during the preheating phase and therefore in damage to the lamp. Furthermore, voltages are prevented which result in unintentional reignition and therefore in a risk of an accident owing to electric shock for the user.

Figure 2:
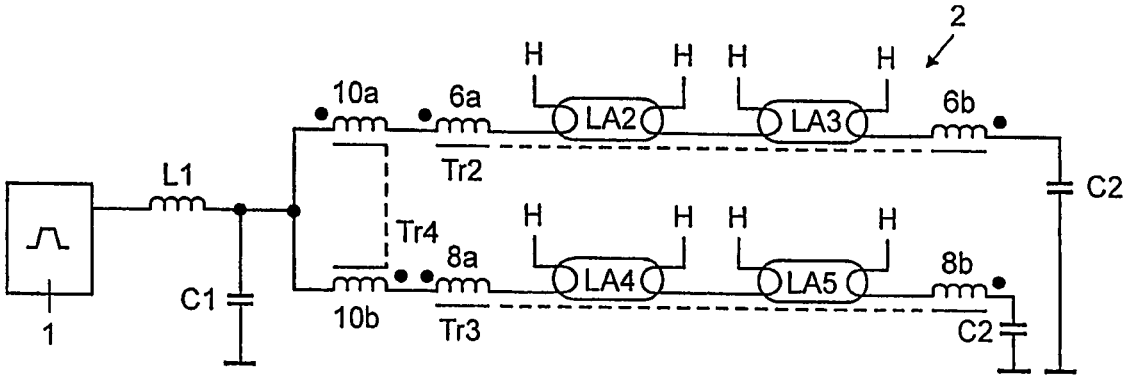
FIG. 2 shows a schematic circuit arrangement of an electronic ballast in accordance with a second exemplary embodiment.

FIG. 2 shows a schematic illustration of a circuit arrangement of an electronic ballast suitable for operating two parallel-connected lamp arrangements 2, two parallel-connected current branches being connected to the first terminal of the resonant capacitor C1 and to the first terminal respectively of a half-bridge capacitor C2, in each case two series-connected lamps LA2, LA3 or LA4, LA5 being connected into said two parallel-connected current branches. In this variant of the invention, in each case one transformer Tr2, Tr3 is provided in each of the two parallel-connected current branches, a first winding 6*a* or 8*a* of the transformers being arranged upstream of the lamp arrangement 2, and a second winding 6*b* or 8*b* of the transformers being arranged downstream of the lamp arrangement 2. The windings 6*a*, 6*b* or 8*a*, 8*b* each have opposite winding senses given the same number of turns and form a differential current transformer, which balances the lamp currents directly upstream and downstream of the lamp arrangement 2. According to the invention, the two transformers Tr2, Tr3 are in the form of saturation balancing inductors, which carry out both the balancing of the lamp currents required for uniformly bright illumination of the series-connected lamps LA2, LA3 or LA4, LA5 and the limitation of the voltages occurring as a result of saturation of the ferromagnetic transformer core which is set in a defined manner. As a result, firstly voltages are avoided which result in premature ignition of the lamp during the preheating phase and therefore in damage to the lamp and, secondly, voltages are prevented which result in unintentional reignition and therefore in the risk of an accident owing to an electric shock for the user.

In addition, in each case one winding 10*a*, 10*b* of a balancing transformer Tr4, which does not operate in the saturation region, is connected upstream of the first windings 6*a*, 8*a* of the transformers Tr2, Tr3. Said balancing transformer Tr4 likewise acts as a differential current transformer and balances the partial currents in the parallel-connected current branches, with the result that the lamps LA2, LA3 in the first current branch illuminate at the same brightness, even in the case of severe dimming, as the lamps LA4, LA5 in the second current branch.

Figure 3:
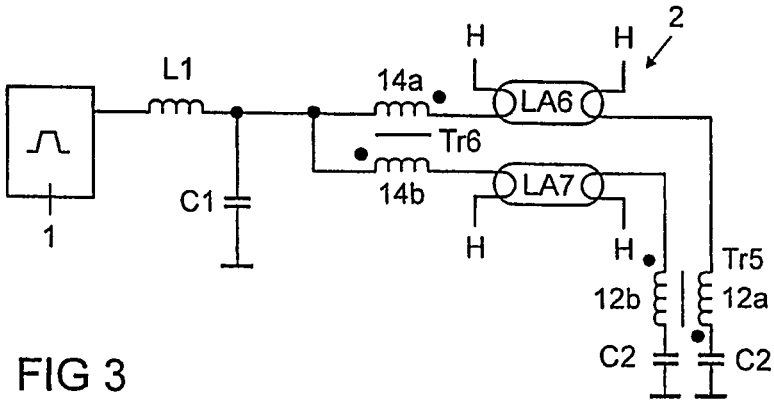
FIG. 3 shows a schematic circuit arrangement of an electronic ballast in accordance with a third exemplary embodiment.

In accordance with a third exemplary embodiment of the invention, the electronic ballast is used for operating two lamp arrangements 2 in parallel-connected current branches. FIG. 3 shows the schematic circuitry of this ballast. Two parallel-connected current branches, into which in each case one lamp LA6, LA7 is connected, are connected to the first terminal of the resonant capacitor C1 and to the first terminal of in each case one half-bridge capacitor C2. That is to say, in this embodiment, the series resonant circuit is arranged upstream of the parallel circuit comprising the current branches. A first winding 12*a* of the saturation balancing transformer Tr5 is arranged downstream of the first lamp LA6, and a second winding 12*b* of this transformer Tr5 is arranged downstream of the second lamp LA7, in each case one winding 14*a* or 14*b* of a balancing transformer Tr6 being connected upstream of the lamps LA6, LA7 in the parallel-connected current branches (i.e. a transformer which does not operate in the saturation region). Said balancing transformer Tr6, as has already been explained, likewise operates as a differential current transformer and balances the partial currents in the parallel-connected current branches. This ensures that all the lamps of the lamp arrangement illuminate at the same brightness. In this exemplary embodiment as well, the saturation balancing inductor Tr5 carries out both the balancing of the lamp currents required for uniformly bright illumination of the lamps and the limitation of the voltages occurring as a result of saturation of the ferromagnetic transformer core which is set in a defined manner, at a current in the range of 5-50 mA.

Figure 4:
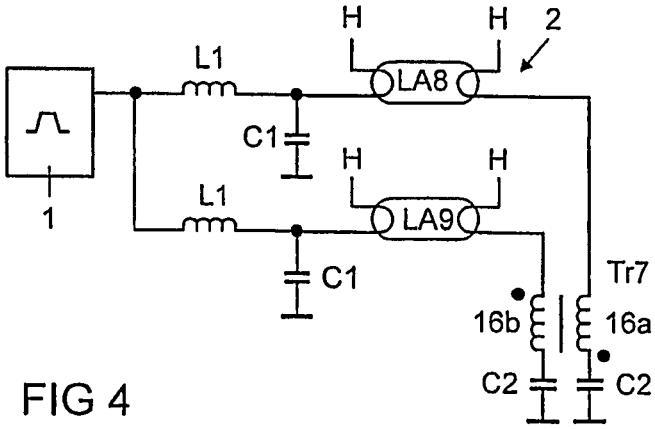
FIG. 4 shows a schematic circuit arrangement of an electronic ballast in accordance with a fourth exemplary embodiment.

FIG. 4 likewise shows a schematic circuit arrangement of an electronic ballast which is suitable for operating two parallel-connected lamp arrangements 2. This variant uses two parallel-connected current branches, which are each designed to have a series resonant circuit comprising a resonant capacitor C1 and a resonant coil L1, a lamp LA8, LA9 being connected to the first terminal of the resonant capacitor C1 and to the first terminal of in each case one half-bridge capacitor C2. A first winding 16*a* of a saturation balancing transformer Tr7 is arranged downstream of the first lamp LA8, and a second winding 16*b* of this transformer is arranged downstream of the second lamp LA9. This transformer balances the partial currents in the parallel-connected current branches since these partial currents may differ from one another, for example owing to different manufacturing tolerances of the capacitors and coils used. According to the invention, the saturation balancing inductor Tr7 carries out both the balancing of the lamp currents required for uniformly bright illumination of the lamps LA8, LA9 and the limitation of the voltages occurring as a result of saturation of the ferromagnetic transformer core which is set in a defined manner, at a current in the range of 5-50 mA, and given the associated safety in terms of unintentional ignition of the lamp. As a result, the safety provisions (thumb test) are adhered to and a uniform lighting effect of the lamps is ensured.

The invention discloses an electronic ballast for operating a lamp arrangement having at least one lamp, in particular a low-pressure discharge lamp, and at least one transformer for balancing the lamp currents, the transformer having two windings, which are assigned to one or more lamps of the lamp arrangement. According to the invention, the transformer is in the form of a saturation balancing inductor.

The invention claimed is:

1. An electronic ballast for operating a lamp arrangement, the electronic ballast comprising:

a transformer in the form of a saturation balancing inductor for balancing current in the lamp arrangement, the lamp arrangement comprising one or more low-pressure discharge lamps, the transformer comprising:

a first winding upstream of the lamp arrangement;

a second winding downstream of the lamp arrangement; and a transformer core, wherein the transformer is configured for a current intensity to saturate the transformer core such that the turns of the transformer decouple at a voltage lower than required for igniting the one or more low-pressure discharge lamps, wherein the current intensity to saturate the transformer core comprises a range of 5 mA to 50 mA.

2. The electronic ballast of claim 1, wherein at least two lamp arrangements are connected in parallel to form at least two current branches, the electronic ballast further comprising the transformer in each of the current branches.

3. The electronic ballast of claim 2, wherein the electronic ballast further comprises a balancing transformer that does not operate in the saturation region, wherein a winding of the balancing transformer is upstream of each of the first windings of the transformer.

4. The electronic ballast of claim 1, wherein the electronic ballast further comprises a series resonant circuit, the series resonant circuit comprising a coil and a capacitor.

5. The electronic ballast of claim 1, wherein the number of turns of the first winding equals the number of turns of the second winding and the winding direction of the first winding is in the opposite direction of the winding direction of the second winding.

6. The electronic ballast of claim 1, wherein the electronic ballast further comprises an inverter.

7. An electronic ballast for operating a first lamp arrangement and a second lamp arrangement, the electronic ballast comprising:

a transformer in the form of a saturation balancing inductor for balancing current in the first and the second lamp arrangement, the first and the second lamp arrangement forming two current branches connected in parallel and the first and the second lamp arrangement each comprising one or more low-pressure discharge lamps, the transformer comprising:

a first winding downstream of the first lamp arrangement;

a second winding downstream of the second lamp arrangement; and a transformer core, wherein the transformer is configured for a current intensity to saturate the transformer core such that the turns of the transformer decouple at a voltage lower than required for igniting the one or more low-pressure discharge lamps of the first and the second lamp arrangements, wherein the current intensity to saturate the transformer core comprises a range of 5 mA to 50 mA.

8. The electronic ballast of claim 7, wherein the electronic ballast further comprises a balancing transformer that does not operate in the saturation region, wherein a first winding of the balancing transformer is upstream of the first lamp arrangement and a second winding of the balancing transformer is upstream the second lamp arrangement.

9. The electronic ballast of claim 7, wherein the electronic ballast further comprises a series resonant circuit, the series resonant circuit comprising a coil and a capacitor.

10. The electronic ballast of claim 9, wherein the resonant circuit is upstream of the two current branches.

11. The electronic ballast of claim 9, wherein the electronic ballast further comprises the series resonant circuit in each of the two current branches, the series resonant circuits being respectively upstream of the first lamp arrangement and the second lamp arrangement.

12. The electronic ballast of claim 7, wherein the number of turns of the first winding equals the number of turns of the second winding and the winding direction of the first winding is in the opposite direction of the winding direction of the second winding.

13. The electronic ballast of claim 7, wherein the electronic ballast further comprises an inverter.

* * * * *